US006401811B1

(12) United States Patent
Coone

(10) Patent No.: US 6,401,811 B1
(45) Date of Patent: Jun. 11, 2002

(54) TOOL TIE-DOWN

(75) Inventor: Malcolm G. Coone, Katy, TX (US)

(73) Assignee: Davis-Lynch, Inc., Pearland, TX (US)

( * ) Notice: Subject to any disclaimer, the term of this patent is extended or adjusted under 35 U.S.C. 154(b) by 0 days.

(21) Appl. No.: 09/557,229

(22) Filed: Apr. 24, 2000

Related U.S. Application Data

(60) Provisional application No. 60/131,887, filed on Apr. 30, 1999.

(51) Int. Cl.[7] ..... E21B 19/00

(52) U.S. Cl. ..... 166/85.1; 166/75.14; 166/96.1; 175/162

(58) Field of Search ..... 166/75.14, 85.1, 166/96.1, 341, 381, 382, 385; 175/162; 294/102.2

(56) References Cited

U.S. PATENT DOCUMENTS 2,263,364 A * 11/1941 Nichols ..... 294/102.2
3,316,963 A * 5/1967 Boldrick et al. ..... 166/298
3,353,595 A * 11/1967 Nelson et al. ..... 166/341
4,407,361 A * 10/1983 Van Winkle ..... 166/298

* cited by examiner

*Primary Examiner*—David Bagnell
*Assistant Examiner*—Jennifer R. Doughtery
(74) *Attorney, Agent, or Firm*—The Matthews Firm

(57) ABSTRACT

A tool tie down system is provided which ties down a well tool inserted into the top end of a casing string being lowered into a well from upward movement caused by pressure forces from below the well tool inside the upper end of the casing string. The system includes a frictionally engageable clasp for supporting a tie down yoke on the bails connecting the traveling block and elevator slips assembly. A plurality of cords attached to the elevator on one end and the tie down yoke on the other end redirect forces from below to hold the well tool in place resisting these forces, the cords being fabricated, for example from an elastomer, a metal or metal alloy, a fiber, or combinations thereof.

9 Claims, 2 Drawing Sheets

TOOL TIE-DOWN

RELATED APPLICATION

This application claims priority from U.S. Provisional Application, Serial No. 60/131,887, filed Apr. 30, 1999.

FIELD OF THE INVENTION

This invention relates to equipment used in the drilling and completion of subterranean wells, and more specifically to a tool tie-down for use with tools and equipment lowered into subterranean wells.

BACKGROUND OF THE INVENTION

The procedure for drilling and completing subterranean wells to recover, for example, oil and gas from a reservoir, consists of boring a hole in the earth down to the reservoir of interest and installing pipe from the reservoir to the surface. Casing is used as a protective liner within the well bore that is cemented in place to insure a pressure-tight connection to the oil and gas reserve. The casing consists of lengths of tubulars, or joints. Casing is run into the well bore one joint at a time. The unfinished well bore has rough sides of raw earth, and, on occasion, the casing becomes stuck against irregularities in the sides of the well bore as it is lowered down. When this occurs, the casing may be forced down the well bore by adding load to the casing string to force the casing down, by circulating fluid down the interior of the casing so that the fluid exits the casing into the annular space between the external side of the casing and the sides of the well bore to free the casing from the well bore, or by a combination of adding load and circulating drilling fluid. To accomplish this, a tool, such as a circulating tool, may be attached to the top end of the casing string.

Drilling fluid is added to the casing string also to provide counter-pressure against the interior walls of the casing string to prevent the casing from being crushed by the high pressures encountered in the well bore. For this use of drilling fluid, the top end of the casing string, at the surface of the well bore, must be sealed as the fluid is added so that sufficient pressure is maintained inside the casing string. To accomplish this, a fill-up tool may be attached to the top of the casing string.

Circulation and fill-up functions may also be provided by a unitary fill-up and circulating tool such as that described in U.S. Pat. No. 5,584,343, issued Dec. 17, 1996.

Another operation for completing finishing a subterranean well is to cement the casing to the wellbore to seal the casing to the earth formation once the casing string is in place. Cementing is typically accomplished by removing the fill-up or circulating tool and installing a cementing head or plug container to the top of the casing. The cementing head is used to pump cement down the casing string and into the annulus between the outside of the casing and the sides of the wellbore until the annulus is filled with cement and a pressure tight seal is obtained. Elastomeric cement plugs are well known in the art of cementing casing or other tubulars in well boreholes. Such plugs are routinely used to wipe the interior of a casing string, and can be used as a mechanical separation between two types of fluids, for example, between drilling fluids and cement. The plug wipes the inside of the casing and separates the cement from the drilling fluid below.

Tools for cementing operations, fill-up, and circulating are attached to the top of the casing string and at least some portion of the tool may be lowered inside the top of the casing string for a particular operation. In such circumstances, the tool may experience high pressures from the wellbore. These pressures act to force the tool up and out of the casing. Traditionally, such tools are prevented from being pushed out of the casing merely by the traveling block to which the tool is attached and the hook or other assembly which attaches the tool to the traveling block. Sometimes the traveling block may have a push plate to push the tubular into the borehole. These traditional structures do not secure the tool in its position in the casing, nor do they "tie-down" the tool to prevent the tool from being ejected from the casing by down hole pressures. The traveling block, hook or push plate are simply the first structures in the way of the tool if it does get ejected from the casing. Ejection of a tool from the casing can be explosive when it occurs, causing substantial damage to the tool and to any structure in its trajectory. To prevent tool ejection and to protect the tool and the rig structures above the tool from catastrophic damage due to tool ejection, it would be useful to have a tool tie-down that resists the upward forces acting on the lowered tool and that secures the tool in a desired position at the top of the casing string.

An example of a tool which is commonly lowered into the top of the casing from a rig and whose operation would benefit from being tied down is a fill-up and circulate ("FAC") tool, such as that described in U.S. Pat. No. 5,584,343, issued Dec. 17, 1996, to Malcolm G. Coone (Davis-Lynch, Inc., Pearland, Tex.), which is incorporated herein by reference in its entirety. When the FAC tool of the '343 patent is inside the casing in a circulate mode, the sealing element or packer of the FAC tool engages the inside of the casing or well bore to create a seal to prevent the escape of fluids from below to above the seal. These fluids are thus under a pressurized condition and act on the FAC tool to push it in an upward direction.

For a FAC tool for standard rotary type rigs, such as described in the '343 patent, the only constraint preventing the seal from being pushed out of the top of the casing when circulating is the top of the FAC tool assembly pushing against the hook on the traveling block of the rig.

Even though the FAC tool is guided to some extent by a yoke mechanism attached to the bails, the yoke has no holding power against an upward force to help keep the seal in the casing when upward pressure is applied from below the seal. Therefore, the weight of the hook and traveling block is the only downward force keeping the seal inside the casing under pressure from below.

During circulation, the FAC tool is placed in a compression mode, by the pressure from below the seal pushing upwardly. The top of the FAC tool pushes against the rounded portion of the bottom of the traveling block/tool. This causes the FAC tool to be unstable in the presence of strong upward pushing or compression forces. Thus, this type of assembly limits the amount of pressure that can be applied below the seal or packer element of the FAC tool.

Pressure applied from below a FAC tool that has been tied using the tie-down tool also puts the FAC tool in compression. However, in accordance with the invention, the upwardly directed force is absorbed by a pair of cords fabricated, for example from an elastomer, a metal or metal alloy, a fiber, or combinations thereof tied back to the bottom eyes of the bails. These cords, in turn, are attached, directly or indirectly, to the elevator or traveling block. The cords redirect the upward force due to the pressure from below and use it to hold the force due to this pressure from below being applied directly to the traveling block hook. This redirection of the upward or pressure from below force is thus absorbed by the tool of the present invention. Proper sizing of the cords, and/or selection of suitable cord materials, fabricated, for example, from steel or a steel alloy, allows for higher pressures to be exerted from below the FAC tool seal.

Therefore, provided herein is a tie-down tool comprising a tie-down yoke assembly securable to a rig, and one or more cords securable to the tie-down yoke assembly and to the tool-lowering slips of the rig, to secure a tool in a desired position inside the top end of the casing.

The invention is best understood by the following detailed description taken in conjunction with the drawings. These are intended as only illustrative and not limitative, as the invention may admit to other embodiments to these of skill in the art.

DETAILED DESCRIPTION OF THE INVENTION

Figure 1:
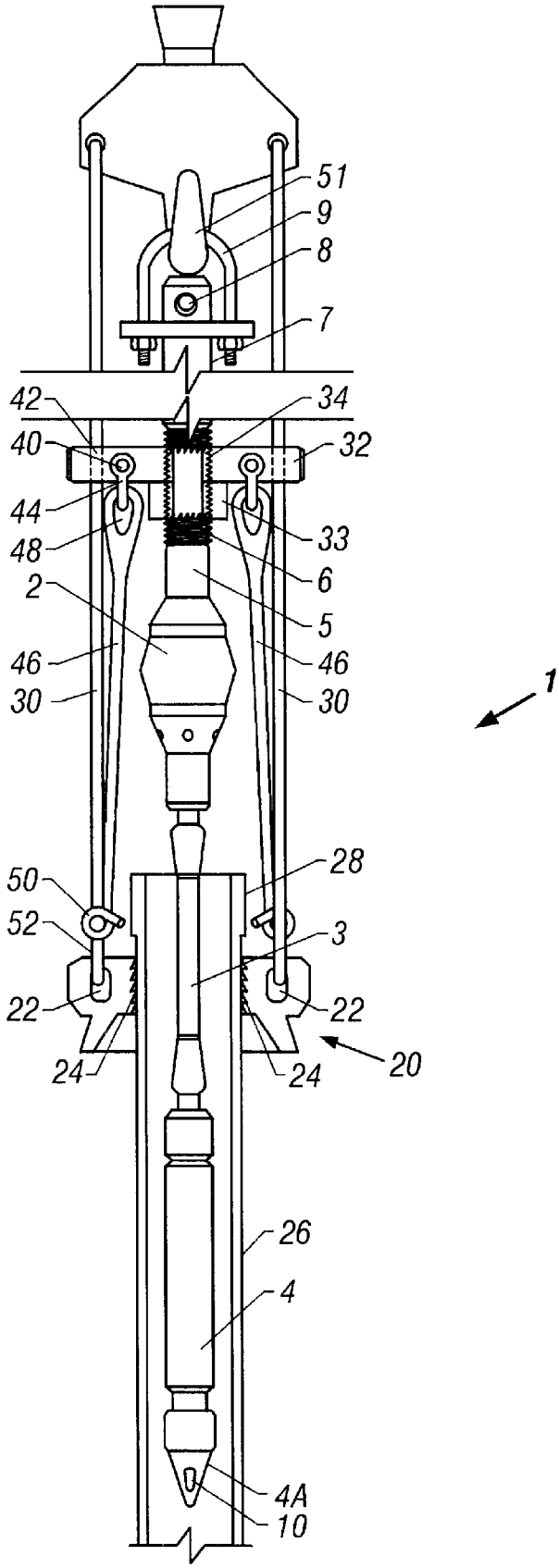
FIG. 1 is a front view of a FAC tool rig assembly shown in partial cross section and showing the present tie-down tool.

While the invention is described below with respect to a FAC tool, it may also be used with other tools as well. Referring to FIG. 1, a fill-up and circulating (FAC) tool 1 is shown as an example to illustrate the present tool tie-down. FAC tool 1 is shown substantially as described in U.S. Pat. No. 5,584,343. A FAC tool 1 includes a radially expandable sealing or packer section 2, a flexible hose 3, a valve sub 4, and guide cone 4A. Upper mandrel 5 is connected to sealing section 2, and comprises a threaded portion 6 distal to sealing section 2. The top end 7 of the tool is threadedly connected to threaded portion 6 of upper mandrel 5, comprises upper port 8, and is connected to a standard rig traveling block 50 by means of a U-bolt yoke mechanism 9. At the other end, guide cone 4A is equipped with a lower port 10. Fluid may be pumped downhole through ports 8 and 10. The FAC tool 1 may be a filling and circulating tool, depending on the position of sealing section 2, such as described in the '343 patent. Those skilled in the art, however, will appreciate that FAC tool 1 is presented herein only as an example to illustrate the present tool tie-down, and that a variety of tools other than FAC tools will benefit from the present invention tie-down tool.

Elevator slips 20 grip casing 26 below casing collar 28. Slips 20 comprise slip eyes 22 and grippers 24. Bails 30 connect slips 20 to the traveling block 50 which supports the weight of the casing.

Tie-down yoke mechanism 32 of the present invention, has an unthreaded bore 34 which slides over the upper threaded part of mandrel 5. The tie-down yoke 32 is limited in downward movement by vertical tightening sleeve 33 to secure tie-down yoke mechanism 32 in a desired vertical position on mandrel 5 and against upward movement by force from below. The sleeve 33 is threadedly attached to FAC tool mandrel 5. Typically, the tie-down yoke mechanism 32 may be positioned with respect to mandrel 5 by sliding tie-down yoke mechanism 32 and screwing sleeve 33 down on mandrel 5 at threaded portion 6 prior to installing top sub 7. Then tightening sleeve 33 upwardly on mandrel 5 against the bottom of yoke 32 to secure yoke mechanism 32 in a desired vertical position on mandrel 5. Tie-down yoke mechanism 32 is disposed around bails 30 in a snug, but slideable relationship. It is frictionally engaged with bails 30 by horizontal tightening bolts 40. An outer arm portion 42 of yoke mechanism 32 may be formed to accommodate links 30. Horizontal tightening bolts 40 also frictionally secure tie-down connectors or eyes 44 to tie-down yoke mechanism 32.

Tie-down members 46 comprise cord members, fabricated, for example from an elastomer, a metal or metal alloy, a fiber, or combinations thereof, and connects tie-down yoke mechanism 32 to bails 30, which in turn are connected to elevator slips 20. Tie-down connector 44 loops through upper (or top) tie-down eye 48 at one end, and lower tie-down eye 50 loops through lower eye 52 of bail 30, at the other end.

Tie-down members 46 preferably comprise a material having high tensile strength. The tensile strength should be sufficient so that one or more tie-down members is able to secure a tool in a desired position in the casing against the back pressures and forces acting on the tool. A suitable material may be selected by estimating the forces that will be encountered, and selecting a material of known strength from which to fabricate tie-down members 46. The properties of a suitable material for tie-down 46 include a high strength to weight ratio, low stretch characteristics, i.e. inelastic, high wear and flex fatigue resistance, and low to non-rotational characteristics. It would also be useful if the material could be spliced readily. The material should also tolerate the extreme temperature, acid, caustic, and corrosive conditions that may be encountered in the field.

An example of a suitable tie-down material is Amsteel Blue™(formerly Spectron 12 plush™), a commercially available synthetic fiber available from The American Group. Amsteel Blue™ has sufficient tensile strength, exceeding that of metallic steel, and also tolerates well the extreme temperature, acid, caustic, and corrosive environments that may be encountered at a drilling site or downhole. Amsteel Blue™ is recommended for a variety of applications, including mooring lines, tug assist lines, face and wing wires, seismic tow lines, winch lines, pulling lines, wire rope replacement, and of particular note for specialty rigging lines. Amsteel Blue™ also floats, a feature which may be useful for offshore operations.

In addition to synthetic or composite fibers, the material of tie-down member 46 may comprise a unitary metallic wire or metallic threads woven together. Tie-down member 46 may further comprise a composite of synthetic fibers and metallic wire woven together to form a cord. In short, the cords may be fabricated, for example from an elastomer, a metal or metal alloy, a fiber, or combinations thereof.

The material may be woven or braided, such as in a rope, to form upper and lower tie-down eyes, 48, 50, respectively. Braiding the material to form the eyes may be accomplished by providing a length of braided material, forming loops at either end of the length and then joining the ends to the body by splicing such as by braiding or weaving the ends into the body. Alternatively, the material may be formed to comprise loops or other suitable linkages.

Figure 2:
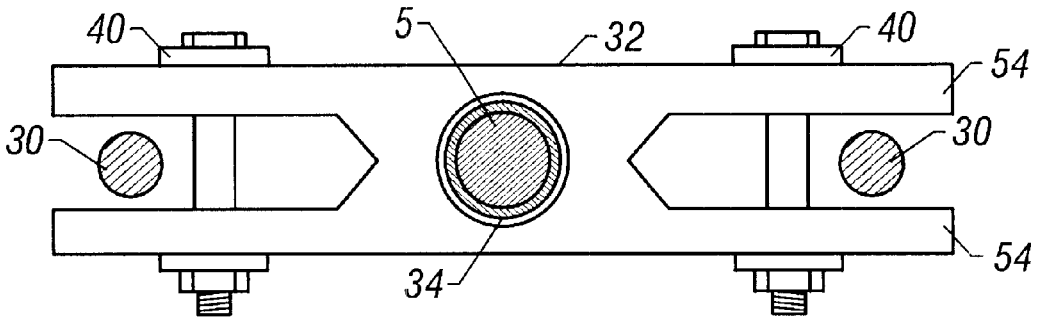
FIG. 2 is a top view of a tie-down tool sub assembly of the present invention.

FIG. 2 is a top view of tie-down yoke mechanism 32. Bails 30 are sandwiched by outer arms or plates 54 of yoke mechanism 32. Plates 54 can be tightened against bails 30 with shackle 40. Shackle 40 comprises a tightening bolt which connects opposing plates 54 whereby shackle 40 can be tightened against plates 54 to contain bails 30. Yoke mechanism 32 further comprises unthreaded bore 34 sized to receive mandrel 5.

Figure 3:
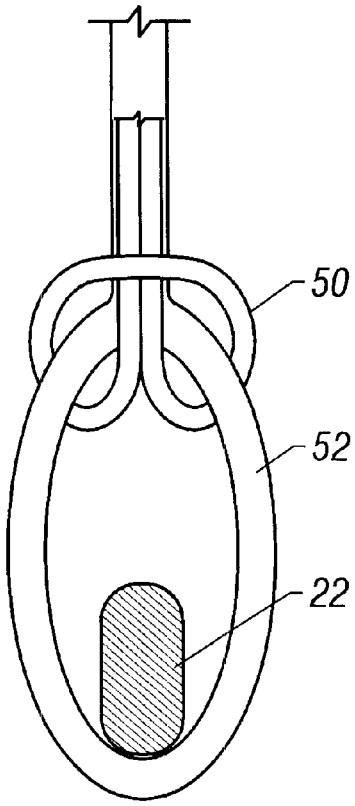
FIG. 3 is a detail of FIG. 1 showing a tie-down connection to the lower eye of the bails.

FIG. 3 is a detail of lower tie-down connection 52. Tie-down eye 50 is looped through bail 30, eye 52 in the same way a suitcase tag with an elastic loop is looped through the handle of a suitcase. In this way, tie-downs can be attached to a bail eye without any special subassembly or connectors. This is an advantage of using a cord over using steel links. Steel links are rigid, and require connecting hooks and blocks to attach to the rigid link eyes of steel links to the rig. The flexible tension member, or tie-down, of the present invention requires no additional equipment to connect the tie-down yoke mechanism 32 to the bails.

The foregoing descriptions may make other variations or embodiments apparent to those of skill in the art. It is the aim of the appended claims to cover all such changes and modifications which fall within the true spirit and scope of the invention.

What is claimed is:

1. A tool tie-down for use with a subterranean drilling rig, wherein the rig has a traveling block assembly to which a well tool is attachable, said well tool having an upper mandrel, and an elevator having casing gripping slips toward the bottom of the traveling block assembly for gripping casing, the tie-down comprising:

a tie-down yoke mechanism securable to the upper mandrel of the well tool; and a tie-down member securable to said tie-down yoke mechanism and with respect to said casing gripping slips, whereby when said well tool is attached to said traveling block assembly and is positioned in an upper end of the casing then said well tool is prevented from being pushed out of position in the casing by pressure from below said well tool in the casing.

2. The tool tie-down of claim 1, wherein the tie-down member comprises a synthetic material.

3. The tool tie-down of claim 1, wherein the tie-down member comprises a flexible material.

4. The tool tie-down of claim 1, wherein the tie-down member comprises a braided cord.

5. The tool tie-down of claim 1, wherein the tie-down member comprises two ends connected by a body, and wherein each end further comprises a loop fabricated, from an elastomer, a metal or metal alloy, a fiber, or combinations thereof.

6. A tool tie-down for use with a subterranean drilling rig, the tie-down tool comprising:

a drilling rig having a traveling block, an elevator and elevator slips, and bails connecting the traveling block to the elevator;

a tool attached to the traveling block of the rig, whereby the tool is capable of being raised and lowered by the traveling block;

a tie-down yoke mechanism securable to the bails connected between the traveling block and the elevator; and one or more cords securable to the tie-down yoke mechanism and to the bails where the bails attach to the elevator slips, to secure the tool in a desired position.

7. A method to tie-down a tool in a subterranean well, the method comprising:

providing a drilling rig comprising a traveling block, elevator slips and bails connecting the traveling block to the elevator slips;

providing a tool attached to the traveling block, whereby the tool is capable of being raised and lowered by the traveling block;

providing a tie-down yoke mechanism securable to the bails associated with the traveling block;

providing one or more cords securable to the tie-down yoke mechanism and to the bails where the bails attach to the elevator slips; and securing a flexible tension member to the tie-down yoke mechanism and with respect to the bails where the bails attach to the elevator slips, to secure the tool in a desired position.

8. The method of claim 7, wherein the one or more cords comprises a first end, the first end comprising a first flexible loop, and a second end comprising a second flexible loop, the method further comprising:

partially inserting the first loop of the flexible tension member through a lower eye of a bail connected to an elevator slip, whereby a portion of the loop extends out of the lower eye of the bail; and connecting the second loop to the tie-down yoke mechanism attached to the bails.

9. A tie down yoke mechanism for use on a well drilling rig having a traveling block assembly, an elevator suspended from a traveling block hook by a set of bails long enough to accommodate a well tool lengthwise therein, an d a set of elevator slips in said elevator for gripping well casing and supporting its weight while lowering into a well borehole, comprising:

means for redirecting upward force on said tool caused by pressure from below the tool to a portion of said yoke mechanism which is frictionally engaged with said set of bails, said means including a sleeve member threadedly attached to said tool and a cord attached to said yoke mechanism at one end and to a bail associated with said elevator at the opposite end, said cord being fabricated, from an elastomer, a metal or metal alloy, a fiber, or combinations thereof.

* * * * *